United States Patent [19]

Agyagos

[11] 4,188,988

[45] Feb. 19, 1980

[54] SHEET ASSEMBLY FOR USE AS A MULTIPURPOSE TOTE BAG

[76] Inventor: Ferenc I. Agyagos, Sangin Bldg., 3-21-5 Akasaka, Minato-ku, Tokyo, Japan

[21] Appl. No.: 914,772

[22] Filed: Jun. 12, 1978

[30] Foreign Application Priority Data

Jun. 13, 1977 [JP] Japan ..... 52-77073[U]
Jun. 26, 1977 [JP] Japan ..... 52-99548[U]

[51] Int. Cl.[2] ..... A45C 3/04

[52] U.S. Cl. ..... 150/1.7; 190/2; 5/417

[58] Field of Search ..... 150/1.7; 190/2, 1; 5/344, 343, 419, 420, 417

[56] References Cited

U.S. PATENT DOCUMENTS

| | | | |
|---|---|---|---|
| 1,604,658 | 10/1926 | Post | 150/1.7 |
| 1,606,107 | 11/1926 | Simms | 150/1.7 |
| 1,672,322 | 6/1928 | Keiser | 150/1.7 |
| 1,730,603 | 10/1929 | Carlson | 150/1.7 |
| 2,146,243 | 2/1939 | Aug | 150/35 |
| 3,164,187 | 1/1965 | Simmons | 150/35 |
| 3,489,194 | 1/1970 | Hoover | 190/1 |

FOREIGN PATENT DOCUMENTS

| | | | |
|---|---|---|---|
| 569902 | 6/1945 | United Kingdom | 150/1.7 |

*Primary Examiner*—Ro E. Hart
*Attorney, Agent, or Firm*—Stevens, Davis, Miller & Mosher

[57] ABSTRACT

A sheet assembly for use as a multipurpose tote bag, comprising two layers of waterproof material partially sewn together to form a two-piece sheet formation with an unsewn opening at a top portion, wherein said two-piece sheet formation is adapted to be folded, in a first folding operation in an overlapping manner along vertical and horizontal axes, from predetermined folding points, to form a folded sheet formation in which the folded portions form a top opening and two inside portions of said tote bag, and wherein the folded sheet formation is further foldable in a second folding operation along a center folding axis forming the bottom of said tote bag and is adaptable for forming the tote bag by means of two pairs of fastener attachments sewn in parallel along the vertical axes, with the mating parts of each fastener attachment sewn in parallel and extending from the bottom to the top opening of said tote bag.

10 Claims, 6 Drawing Figures

FIG. 4
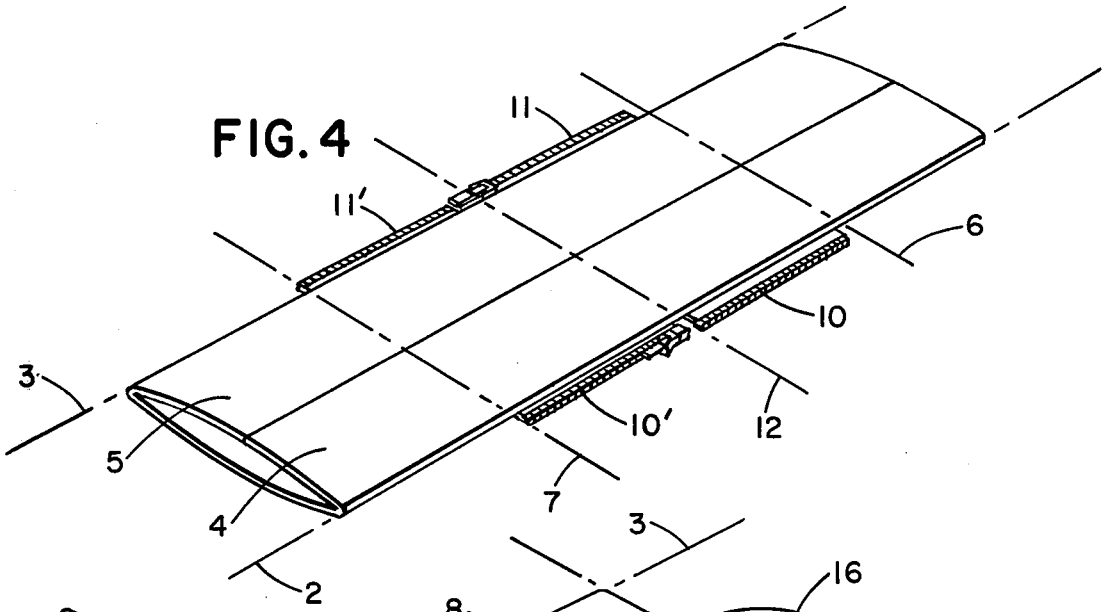
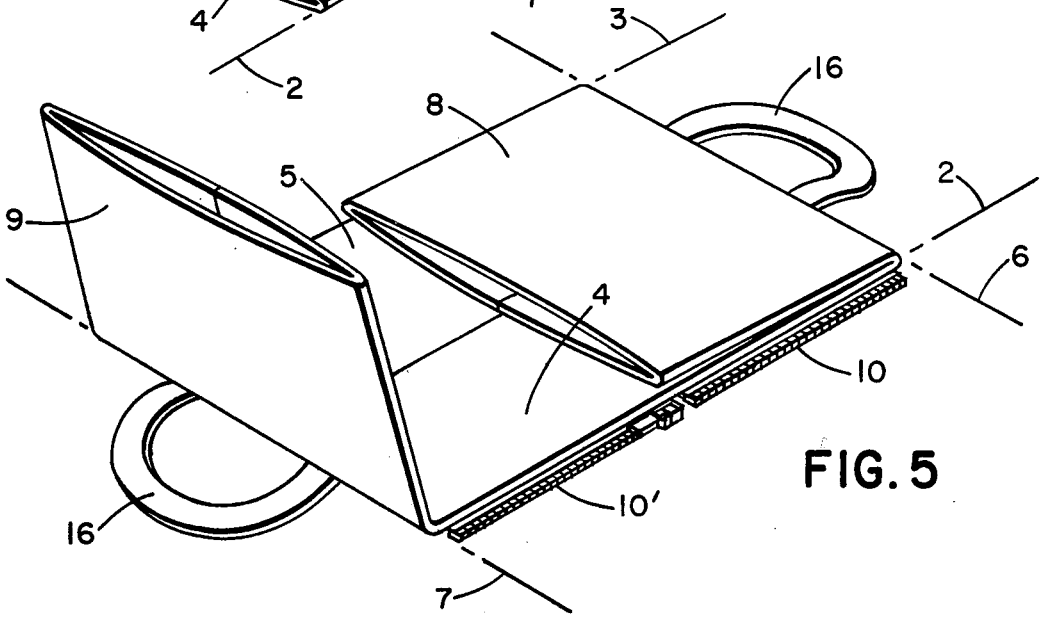
FIG. 5
FIG. 6
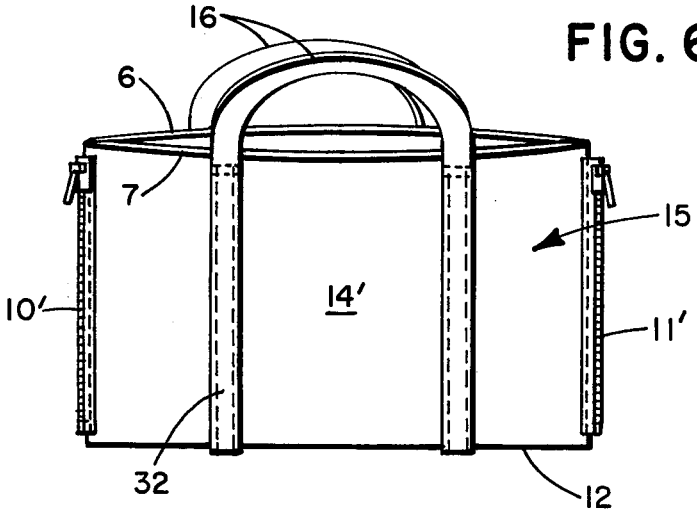

SHEET ASSEMBLY FOR USE AS A MULTIPURPOSE TOTE BAG

BACKGROUND OF THE INVENTION

This invention relates to a sheet assembly useful as a multipurpose tote bag, which can be altered into various other formations for diversified uses, such as conversion to a simple summer sleeping bag, a beach mat, a rain shelter, and so forth, by the unloosening of a pair of fastener attachments positioned at the sides of the bag.

The bag can be converted for use as a ground sheet or a beach mat when fully opened, and, can be refolded and refastened to again form the tote bag.

Hitherto many types of bags, and variations thereon, have been introduced. However, their function has primarily been limited to serving as a mere carrying aid, devoid of other material utilizations.

Accordingly, a need exists for a multipurpose tote bag, which can also be used as a ground sheet or a beach mat when fully opened. The tote bag should be easily convertible into the ground sheet form, and vice versa. Furthermore, the tote bag desirably has additional utilities, such as use as a sleeping bag, a dressing closet, a rain shelter, etc. Still further it would be desirable to provide a tote bag which is designed so that it can contain and accommodate goods by means of convenient pockets even when the bag is converted for alternative use applications.

SUMMARY OF THE INVENTION

A sheet assembly for use as a multipurpose tote bag, comprising two layers of material partially sewn together to form a two-piece sheet formation with an unsewn opening at a top portion. The two-piece sheet formation is adapted to be folded, in a first folding operation in an overlapping manner along vertical and horizontal axes, from determined folding points, to form a folded sheet formation in which the folded portions form a top opening and two inside portions of said tote bag. The folded sheet formation is further foldable in a second folding operation along a center folding axis forming the bottom of said tote bag and is adaptable for forming the tote bag by means of two pairs of fastener attachments sewn in parallel along the vertical axes, with the mating parts of each fastener attachment sewn in parallel and extending from the bottom to the top opening of said tote bag.

The foregoing and other features of the invention can be appreciated from the following description and claims, taken in conjunction with the accompanying drawings.

BRIEF DESCRIPTION OF THE DRAWINGS

FIG. 4 is a perspective view of the sheet assembly according to the invention, folded along one set of axes during the first folding operation in forming said tote bag.

FIG. 5 is also a perspective view of the sheet assembly of FIG. 4, showing the subsequent folding along the perpendicular set of axes completing said first folding operation in forming said tote bag.

FIG. 6 is a perspective view of the completed multipurpose tote bag constructed in accordance with the invention.

DESCRIPTION OF PREFERRED EMBODIMENTS

Figures 1, 3:
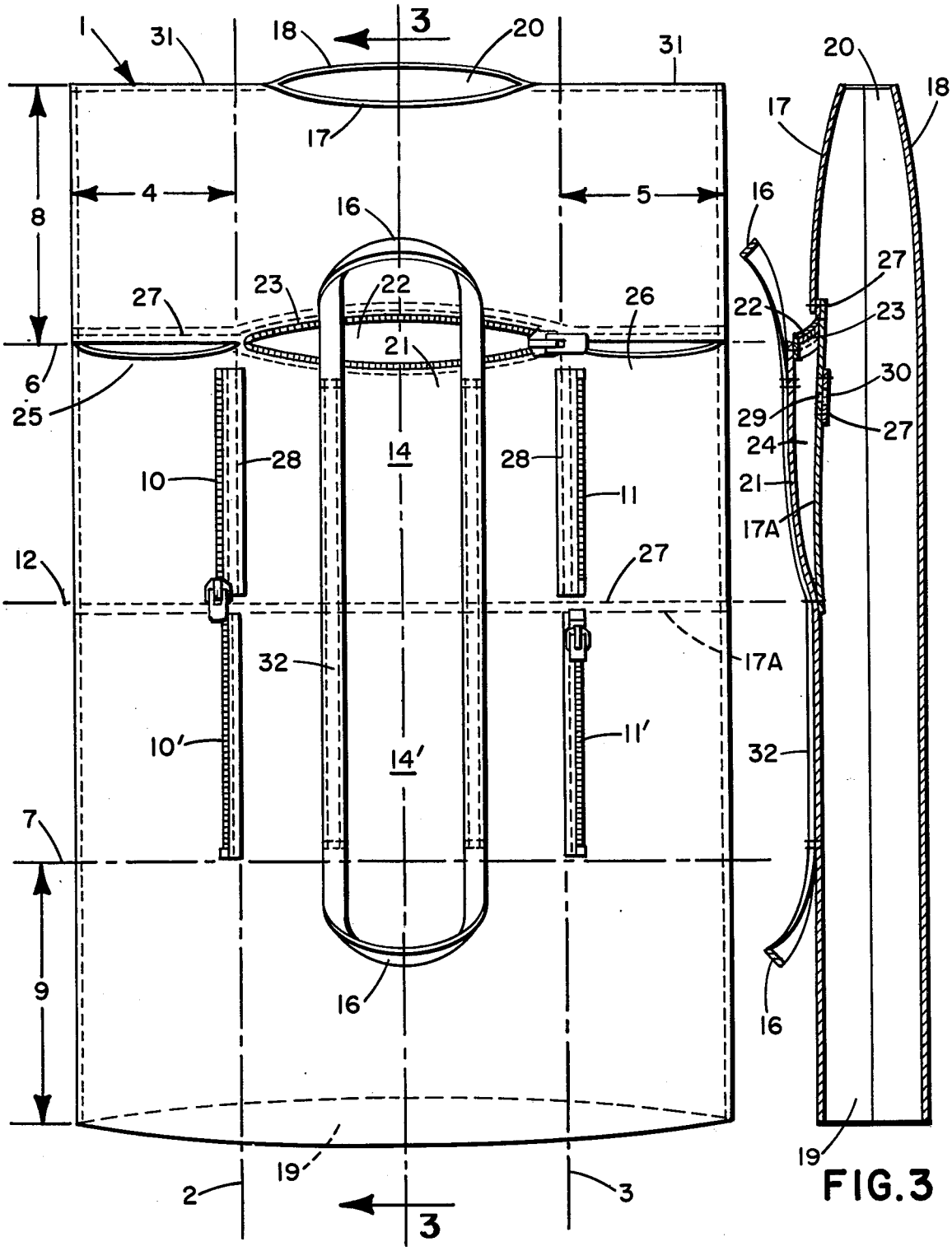
FIG. 1 is a front perspective view of the unfolded sheet of a preferred embodiment of a multipurpose tote bag constructed in accordance with the invention.
FIG. 3 is a vertical sectional view taken along line 3—3 of the unfolded tote bag of FIG. 1.
Figure 2:
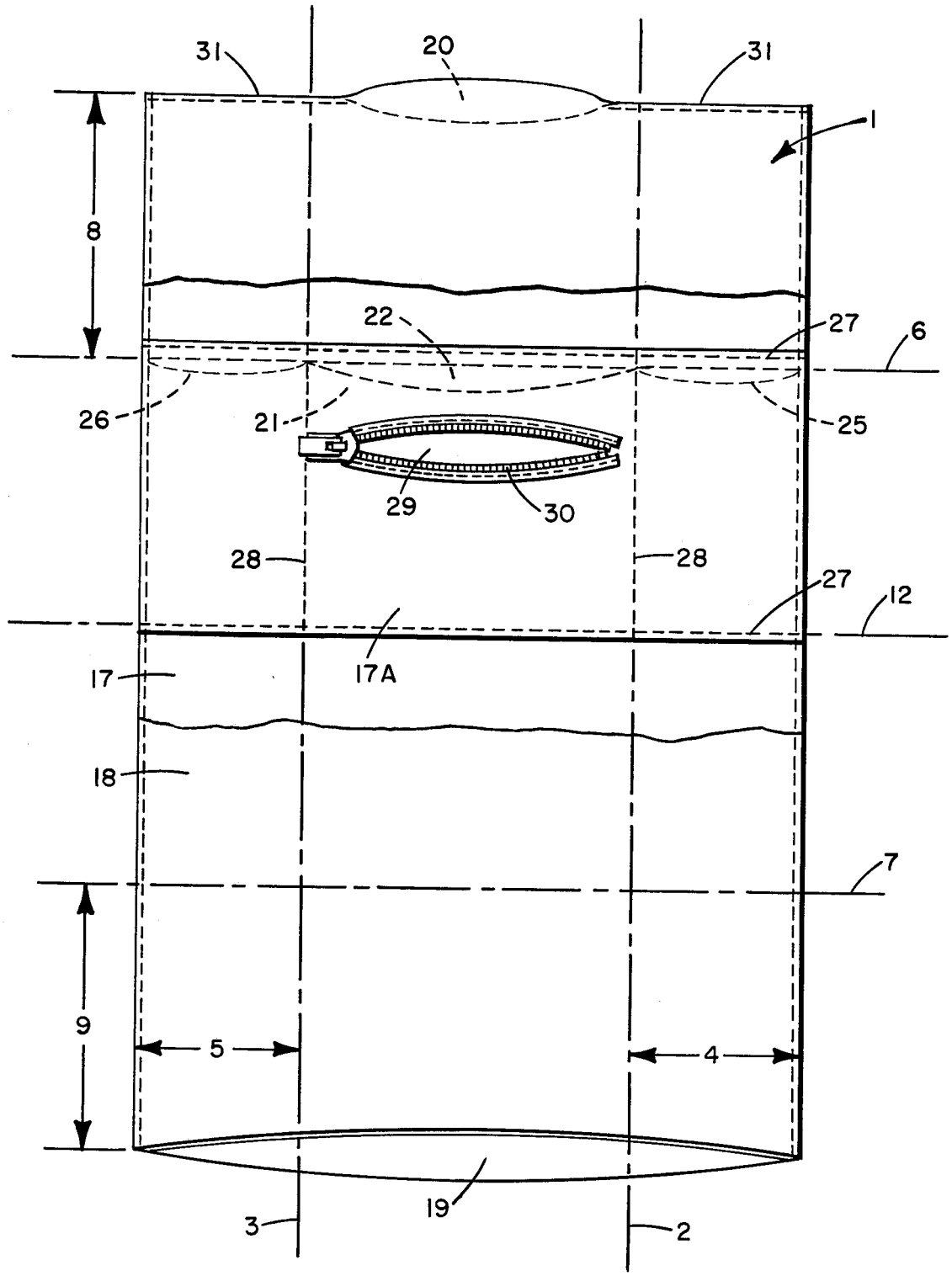
FIG. 2 is a rear perspective view of the unfolded multi-purpose tote bag of FIG. 1 with part of the back panel broken away to show an interior opening 29.

The sheet assembly is useful as a multipurpose tote bag according to the invention, and is comprised of two panels of material which become the front and the back panels respectively, sewn partially together at the horizontal top edge and along the vertical sides, into an assembly that can serve as a ground sheet or beach mat as seen in FIGS. 1 and 2.

Reference is now directed to FIGS. 1 and 2, which illustrate the unfolded ground sheet formation of the multipurpose tote bag constructed in accordance with the invention, comprising a front panel 17 and a back panel 18 which are sewn together partially at the top and throughout the sides to form a single ground sheet formation 1.

Reference numbers 2 and 3 indicate the vertical folding axes, and 6 and 7 indicate the horizontal folding axes, which will involve folded sections 5, 4 to be overlapped by sections 8 and 9 to form the inner section of the bag, while the center folding line 12 will comprise the bottom section; 6 and 7 the top opening portion, 14, 14' the outer section halves to be combined into the completed bag 15 with hand grips 16. The sides of the bag are closed by two zipper fasteners 10, 10' and 11, 11'.

There are three pocket sections 25, 21, 26 positioned on the front panel 17 of the assembly 1. The interior wall of pockets 25, 21, 26 is formed by a panel 17A sewed to the inside of front panel 17 by horizontal lines of stitching 27 and vertical lines of stitching 28 together with the vertical edge stitching that secures the outer vertical edges of the front and real panels 17, 18.

The width of these pockets are determined by means of vertical lines of stitching 28. The middle pocket 21 has a zipper fastener 23 so that valuables can be contained and inserted via the opening 22 in front panel 17.

The procedure by which the ground sheet or the beach mat is formed into completed bag is as follows:

The unfolded bag is initially folded vertically inwards along lines 2 and 3, as seen in FIG. 4.

Next the sheet assembly is folded horizontally inwards along lines 6 and 7 predetermined lengths from the top and bottom ends of the sheet assembly so as to overlap the former vertically creased formation and parallel to the center line 12 of the sheet, as seen in FIG. 5.

The thus-folded sheet formation is again folded, into two halves along line 12, so that the aforementioned horizontal lines 6 and 7 form the top opening of the bag 15 as seen in FIG. 6. The top and bottom portions of the sheet are thus folded inside the final bag formation.

These halves are joined on the sides to form the completed bag by means of zipper fasteners 10, 10' and 11, 11' sewn in parallel to the edges of the aforementioned two vertical folding axes 2 and 3 with each of the mating parts extending from the center folding axis 12 to the upper and the lower horizontal folding lines 6 and 7, respectively.

Thus, the zipper fasteners are perpendicular to the center folding axis and also perpendicular to the upper and lower horizontal folding axes.

After all the folding operations are finished, the bag is completed by closing the zipper fasteners 10, 10' and 11, 11'.

A fabric tape 32 is sewn to the front of panel 17 in a long O-form extending from the horizontal center line beyond lines 6 and 7 to form a pair of hand grips 16 for the folded bag.

In another possible embodiment (not shown) of this invention; the bag is equipped with other convenience pockets in which things can be safely contained and accommodated not only while being used as a tote bag per se, but also when it is being used for other applications.

Furthermore, openings 19 and 20 in the bottom and top of the ground sheet enable a person to cover himself or herself completely with the sheet assembly, with only the head protruding outside the sheet assembly through the top opening 20. This enables the sheet assembly to be used as a rain shelter or for dressing or undressing on the beach.

In the case where the tote bag is used as a dressing closet on the beach, a person may enter into the sheet 1 through the opening 19 at the bottom, protruding the head through the opening 20, with the top section 31 of the sheet resting on the shoulders of the person.

When changing clothes inside the sheet assembly, a person can remove his or her apparel and deposit them in the pocket 21 from the inner opening 29 in panel 17A that also has a zipper fastening 30. Furthermore, after undressing, the person can reach through the inner opening 29 to get a swimming suit that has been put into container 24 of pocket 21 beforehand, from the outside, via opening 22.

It should be understood that many other modifications and variations in the particular embodiments can be made within the scope of the invention.

I claim:

1. A sheet assembly for use as a multipurpose tote bag, comprising:

two layers of waterproof material partially sewn together to form a two-piece sheet formation with an unsewn opening at a top portion, wherein said two-piece sheet formation is adapted to be folded, in a first folding operation in an overlapping manner along vertical and horizontal axes, from predetermined folding points, to form a folded sheet formation in which the folded portions form a top opening and two inside portions of said tote bag, and wherein the folded sheet formation is further foldable in a second folding operation along a center folding axis forming the bottom of said tote bag and is adaptable for forming the tote bag by means of two pairs of fastener attachments sewn in parallel along the vertical axes, with the mating parts of each fastener attachment sewn in parallel and extending from the bottom to the top opening of said tote bag, said two-piece sheet formation having unsewn openings at top and bottom portions.

2. A sheet assembly for use as a multipurpose tote bag as in claim 1, wherein an additional sheet of material is sewn onto a portion of the layer of material forming a side of said tote bag.

3. A sheet assembly for use as a multipurpose tote bag as in claim 2, wherein an additional sheet of material is sewn onto a portion of the layer of material forming a side of said tote bag.

4. A sheet assembly for use as a multipurpose tote bag as in claim 1, wherein the fastener attachments are attached along one set of said vertical and horizontal axis via auxiliary sheets, said auxiliary sheets forming additional side portions of said tote bag.

5. A sheet assembly for use as a multipurpose tote bag as in claim 4, wherein an additional sheet of material is sewn onto a portion of the layer of material forming a side of said tote bag.

6. A sheet assembly for use as a multipurpose tote bag as in claim 1, wherein at least one pocket is formed on the outside portion of said tote bag closest to the top of the sheet assembly.

7. A sheet assembly for use as a multipurpose tote bag as in claim 6, wherein an additional sheet of material is sewn onto a portion of the layer of material forming a side of said tote bag.

8. A sheet assembly for use in the forms of a tote bag, a beach mat or ground cover, a rain shelter, and a portable dressing closet, comprising:

front and back rectangular sheets of waterproof material having substantially equal length and width dimensions, one or more additional sheets of waterproof material of smaller dimensions than said front and back sheets, two fastener attachments each comprising two mating parts, and a pair of handles;

wherein said front and back rectangular sheets are attached to each other along both lengthwise side edges, and are partially attached to each other along a top widthwise edge, with an opening in the middle portion of the top edge;

said one or more additional sheets are attached to the top sheet within an area bounded by the width of the front sheet and that portion of the length of the front sheet between a horizontal center folding axis bisecting the front sheet across its width and a second horizontal axis located about one-half the distance between said center folding axis and the top edge of the front sheet, with openings to form one or more pockets;

said fastener attachments are attached to the front sheet in an alignment parallel to each other and to the lengthwise side edges of the front sheet, and the mating parts of each fastener attachment are attached to the front sheet on opposite sides of the horizontal center folding axis;

said handles are attached to the front sheet, with a gripping portion of one handle extending from the front sheet at a position located above the center folding axis and about one-half the distance between the center folding axis and the top edge of the front sheet and about one-half the width of the front sheet, and the gripping portion of the other handle being symmetrically located at a position below the center folding axis;

and further wherein said sheet assembly, serviceable in an unfolded disposition for use as a beach mat or ground cover, a rain shelter, and a portable dressing closet, is adaptable to be reversibly converted to a tote bag by:

folding the sheet assembly inwardly along two vertical axes adjacent to the parallel fastener attachments such that the front sheet forms the exterior of the once-folded assembly;

folding the once-folded sheet assembly inwardly again along two horizontal axes located about one-half the distance, above and below, respectively, the horizontal center folding axis;

folding the twice-folded sheet assembly inwardly about the horizontal center folding axis such that the mating parts of the fastener attachments are adjacent one another and are mateable to complete conversion of the sheet assembly to use as a tote bag.

9. A sheet assembly as in claim 8 wherein at least one of the mating parts of each of the fastener attachments is attached to the front sheet by means of a piece of material, such that said piece of material forms a side of the tote bag when the sheet assembly is adapted for use as a tote bag.

10. A sheet assembly as in claim 8 wherein at least one pocket is adapted to be closed and opened by means of a fastener attachment positioned adjacent said pocket on the front sheet and a fastener attachment positioned at the opening between the front sheet and the additional sheet forming the pocket.

* * * * *